US011628583B2

(12) United States Patent
Lee et al.

(10) Patent No.: US 11,628,583 B2
(45) Date of Patent: Apr. 18, 2023

(54) ADAPTER FOR A HANDLE AND A CARTRIDGE OF DIFFERENT RAZOR SYSTEMS

(71) Applicant: The Gillette Company LLC, Boston, MA (US)

(72) Inventors: Alejandro Carlos Lee, Cambridge, MA (US); Vincent Paul Walker, Plymouth, MA (US)

(73) Assignee: The Gillette Company LLC, Boston, MA (US)

( * ) Notice: Subject to any disclaimer, the term of this patent is extended or adjusted under 35 U.S.C. 154(b) by 0 days.

(21) Appl. No.: 17/337,704

(22) Filed: Jun. 3, 2021

(65) Prior Publication Data

US 2021/0283792 A1 Sep. 16, 2021

Related U.S. Application Data

(62) Division of application No. 15/169,631, filed on May 31, 2016, now Pat. No. 11,052,558.

(51) Int. Cl.

| | |
|---|---|
| ***B26B 21/52*** | (2006.01) |
| ***B26B 21/22*** | (2006.01) |
| ***B26B 21/40*** | (2006.01) |
| ***B26B 21/14*** | (2006.01) |

(52) U.S. Cl.

CPC ..... *B26B 21/521* (2013.01); *B26B 21/14* (2013.01); *B26B 21/225* (2013.01); *B26B 21/40* (2013.01)

(58) Field of Classification Search

CPC ..... B26B 21/14; B26B 21/521; B26B 21/52; B26B 21/22; B26B 21/40; B26B 21/225

USPC ..... 30/526–532, 42–45

See application file for complete search history.

(56) References Cited

U.S. PATENT DOCUMENTS

| | | | | |
|---|---|---|---|---|
| 4,739,553 | A | 4/1988 | Lazarchik | |
| 4,756,082 | A | 7/1988 | Apprille, Jr. | |
| 5,784,790 | A * | 7/1998 | Carson, III | B26B 21/4068 30/527 |
| 5,787,586 | A | 8/1998 | Apprille, Jr. et al. | |
| 5,813,293 | A | 9/1998 | Apprille, Jr. et al. | |
| 5,918,369 | A | 7/1999 | Apprille, Jr. et al. | |
| 7,168,173 | B2 | 1/2007 | Worrick, III | |
| 7,219,430 | B2 | 5/2007 | Fandrey et al. | |
| 7,703,361 | B2 | 4/2010 | Johnson et al. | |
| 8,033,023 | B2 | 10/2011 | Johnson et al. | |

(Continued)

FOREIGN PATENT DOCUMENTS

WO WO-2016/061324 4/2016

*Primary Examiner* — Nhat Chieu Q Do

(74) *Attorney, Agent, or Firm* — Kevin C. Johnson; Joanne N. Pappas

(57) ABSTRACT

An adapter for coupling each of a razor handle and a razor cartridge together is provided. The adapter includes a cartridge engaging portion and a handle engaging portion. The handle engaging portion comprises at least one wall that defines a receptacle for receiving a razor handle and at least one handle protrusion extending from the at least one wall and configured to engage a central recess of a razor handle. The cartridge engaging portion is coupled with the handle engaging portion. The cartridge engaging portion comprises a stem that defines a first recess and a second recess for selectively engaging a first cartridge protrusion and a second cartridge protrusion and a tongue member slidably coupled with the stem and configured to contact a cartridge.

9 Claims, 13 Drawing Sheets

(56) References Cited

U.S. PATENT DOCUMENTS

| | | | | |
|---|---|---|---|---|
| 8,096,054 | B2 | 1/2012 | Denkert et al. | |
| 8,793,880 | B2 | 8/2014 | Taub et al. | |
| D714,492 | S | 9/2014 | Cautaudella et al. | |
| 8,984,756 | B2 * | 3/2015 | Worrick, III | B26B 21/222 30/526 |
| 9,999,981 | B2 | 6/2018 | Bunnell | |
| 2006/0260131 | A1 | 11/2006 | Follo | |
| 2008/0034589 | A1 * | 2/2008 | Nearing | B26B 21/40 30/32 |
| 2011/0067245 | A1 | 3/2011 | Bridges et al. | |
| 2011/0088269 | A1 | 4/2011 | Walker et al. | |
| 2014/0230257 | A1 | 8/2014 | Eagleton et al. | |
| 2017/0087733 | A1 | 3/2017 | Metcalf et al. | |

* cited by examiner

ADAPTER FOR A HANDLE AND A CARTRIDGE OF DIFFERENT RAZOR SYSTEMS

FIELD OF INVENTION

The systems described below generally relate to an adaptor for different razor systems. More particularly, the adapter allows for a razor handle of one type of docking interface to be coupled with a cartridge of a different type of docking interface.

BACKGROUND OF INVENTION

The shaving razor category has many different razor configurations, including razors that are "system" razors which have long lasting handles with replaceable cartridges, and disposable razors where the handle and cartridge are coupled together and the cartridge and handle are thrown out after a time. Razors vary based on many attributes such as number of blades, cartridge shape, chemistry features on the cartridge and so forth. Razors are also manufactured by many different companies with different technology platforms.

Many system razors have their own docking interface between the handle and cartridge. The use of different docking systems is known. For example, MACH3® and many GILLETTE VENUS® razor systems leverage a single point docking system. The GILLETTE SENSOR® and SENSOR® for Women razors have a different docking system with two attachment features that provide the dual function of attaching the cartridge and providing the arc about which the cartridge can pivot. These and other docking systems have been described. See U.S. Pat. Nos. 5,813,293; 5,787,586; 5,918,369; 4,739,553; and 4,756,082, U.S. Design Pat. No. D714,492; and U.S. Patent Application Pub. No. 2011/0067245.

Many reasons exist for why new docking interfaces exist, such as upgrades to technology, ease of attaching/removing the cartridge, and so forth. Some razors even include fixedly attached structures on the razors that attach to the handle. These structures are sometimes referred to as the interconnect feature. See U.S. Pat. Nos. 7,168,173, 7,703,361, and 8,033,023. These interconnect structures, however, are provided with each and every cartridge in a fixed arrangement, and disposed of with the cartridge after use. For example, U.S. Pat. No. 7,703,361, which is similar to the GILLETTE VENUS BREEZE® razor, the cartridge includes the interconnect feature which is not designed for removal from the cartridge housing. The opposing retaining features are attached to receiving regions in the back of the cartridge housing and absent a considerable amount of force, they cannot easily be detached.

Recently the use of adapters has been discussed to allow FUSION® type razors to attach with MACH3® type replaceable cartridges. See U.S. Pat. No. 8,793,880. Despite these advances, there remains a need to provide users with even more flexibility when they select replacement cartridges for their existing system handles.

SUMMARY OF INVENTION

In accordance with one embodiment, an adapter for coupling each of a razor handle and a razor cartridge together is provided. The adapter comprises a handle engaging portion and a cartridge engaging portion. The handle engaging portion comprises at least one wall, a first handle protrusion, and a second handle protrusion. The at least one wall defines a receptacle for receiving a razor handle. The first handle protrusion extends from the at least one wall. The second handle protrusion extends from the at least one wall and is spaced from the first handle protrusion. The first handle protrusion and the second handle protrusion are configured to engage a first recess and a second recess, respectively, of a razor handle. The cartridge engaging portion is coupled with the handle engaging portion. The cartridge engaging portion comprises a stem and a tongue member. The stem defines a first recess and a second recess for selectively engaging a first cartridge protrusion and a second cartridge protrusion. The tongue member is slidably coupled with the stem and is configured to contact a cartridge.

In accordance with another embodiment, an adapter for coupling each of a razor handle and a razor cartridge together is provided. The adapter comprises a handle engaging portion and a cartridge engaging portion. The handle engaging portion comprises a support member and at least one protrusion. The support member defines a recess and comprises an outer surface that is external to the recess. The at least one protrusion is disposed on the outer surface and is configured to frictionally engage a razor handle. The cartridge engaging portion is coupled with the handle engaging portion. The cartridge engaging portion comprises a stem and a tongue member. The stem defines a first recess and a second recess for selectively engaging a first cartridge protrusion and a second cartridge protrusion. The tongue member is slidably coupled with the stem and is configured to contact a cartridge.

In accordance with yet another embodiment, an adapter for coupling each of a razor handle and a razor cartridge together is provided. The adapter comprises a handle engaging portion and a cartridge engaging portion. The handle engaging portion comprises at least one wall and at least one handle protrusion. The at least one wall defines a receptacle for receiving a razor handle. The at least one handle protrusion extends from the at least one wall and is configured to engage a central recess of a razor handle. The cartridge engaging portion is coupled with the handle engaging portion. The cartridge engaging portion comprises a stem and a tongue member. The stem defines a first recess and a second recess for selectively engaging a first cartridge protrusion and a second cartridge protrusion. The tongue member is slidably coupled with the stem and is configured to contact a cartridge.

BRIEF DESCRIPTION OF THE DRAWINGS

It is believed that certain embodiments will be better understood from the following description taken in conjunction with the accompanying drawings in which.

DETAILED DESCRIPTION OF INVENTION

Figure 1:
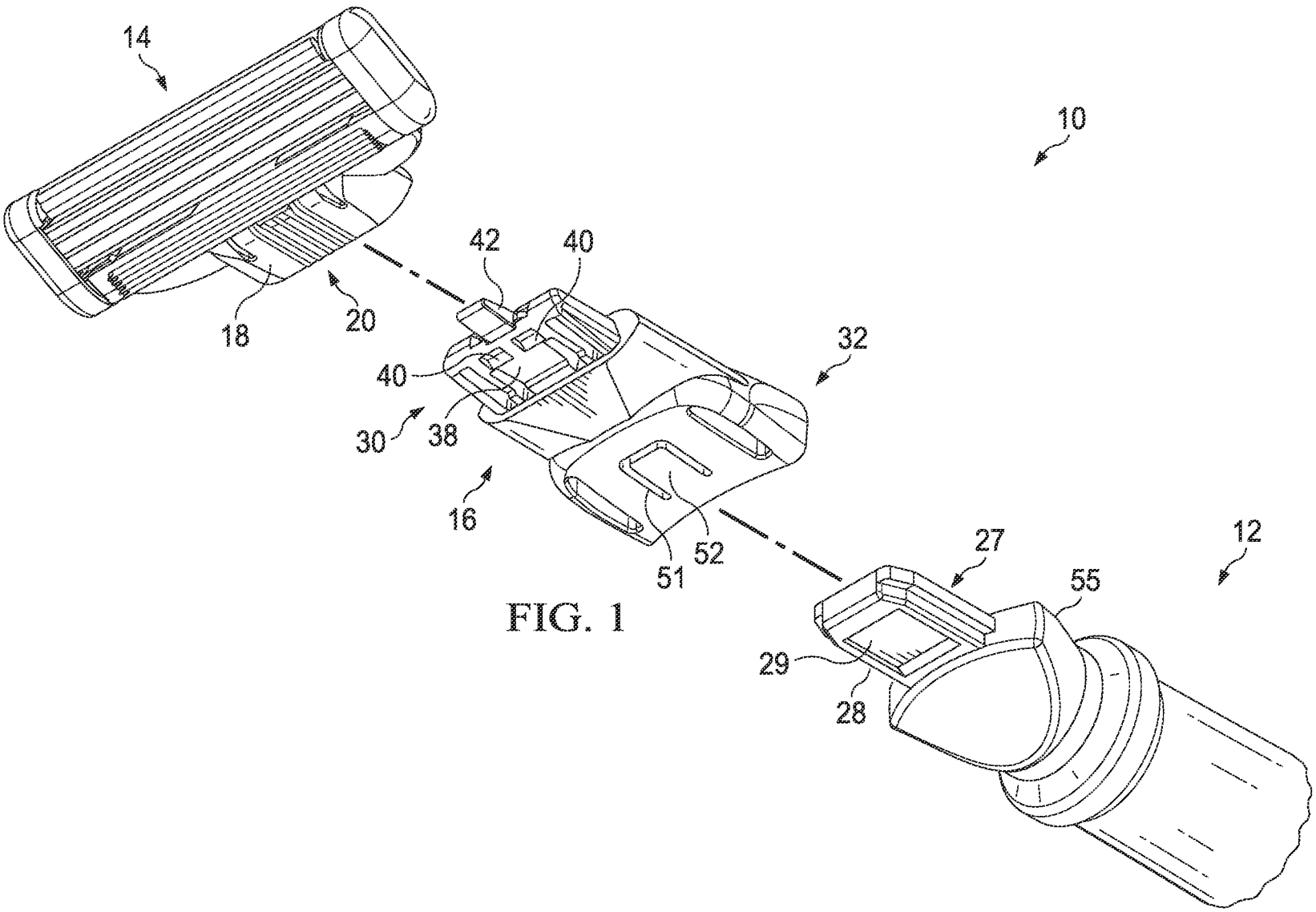
FIG. 1 is an exploded isometric view depicting a razor system having a handle, a cartridge, and an adapter in accordance with one embodiment.
Figure 2:
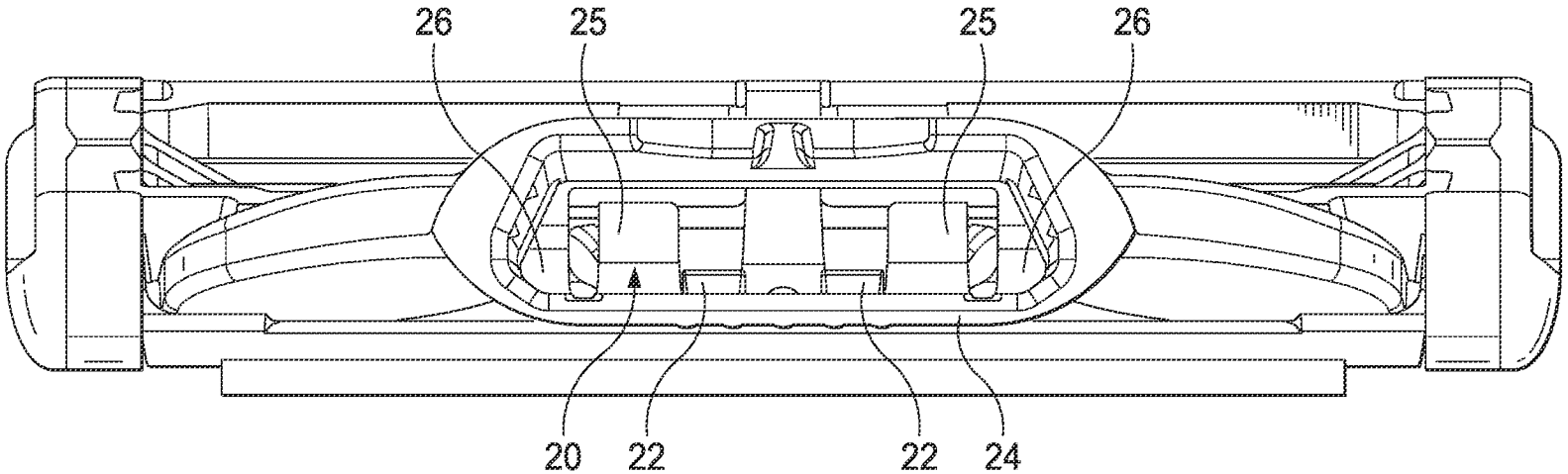
FIG. 2 is a rear plan view depicting the cartridge of FIG. 1.

In connection with the views and examples of FIGS. 1-13, wherein like numbers indicate the same or corresponding elements throughout the views, a razor system 10 is shown in FIG. 1 to include a handle 12, a cartridge 14, and an adapter 16. The handle 12 and the cartridge 14 can have different docking interfaces, and the adapter 16 can be configured to facilitate coupling of the handle 12 to the cartridge 14. As illustrated in FIGS. 1 and 2, the cartridge 14 can be provided with a GILLETTE MACH3® docking interface. The cartridge 14 can have a neck portion 18 that defines a receptacle 20. As illustrated in FIG. 2, a pair of protrusions 22 can extend radially inwardly from a lower wall 24 and can be spaced from each other. A pair of arms 25 can also extend radially inwardly from the lower wall 24 and can be spaced further from each other than the pair of protrusions 22. The cartridge 14 can also include a pair of end portions 26 that are spaced further from each other than the arms 25.

Referring again to FIG. 1, the handle 12 can have a docking interface for a Harry's razor handle which is different from the GILLETTE MACH3® docking interface of the cartridge 14. For example, the handle 12 can comprise a stem 27 having a lower surface 28 that defines a central recess 29 and has an overall shape that does not match the receptacle 20. As such, the cartridge 14 is unable to be mounted directly onto the handle 12. The adapter 16 can include a cartridge engaging portion 30 and a handle engaging portion 32 that are coupled together and are each configured to facilitate coupling of the handle 12 and the cartridge 14 together. In one embodiment, the cartridge and handle engaging portions 30, 32 can be formed together as a unitary one-piece construction. In another embodiment, the cartridge and handle engaging portions 30, 32 can be coupled together with a mechanical connection such as with tabs. Each of the cartridge and handle engaging portions 30, 32 are configured to be compatible with the handle 12 and the cartridge 14, respectively.

Figure 3:
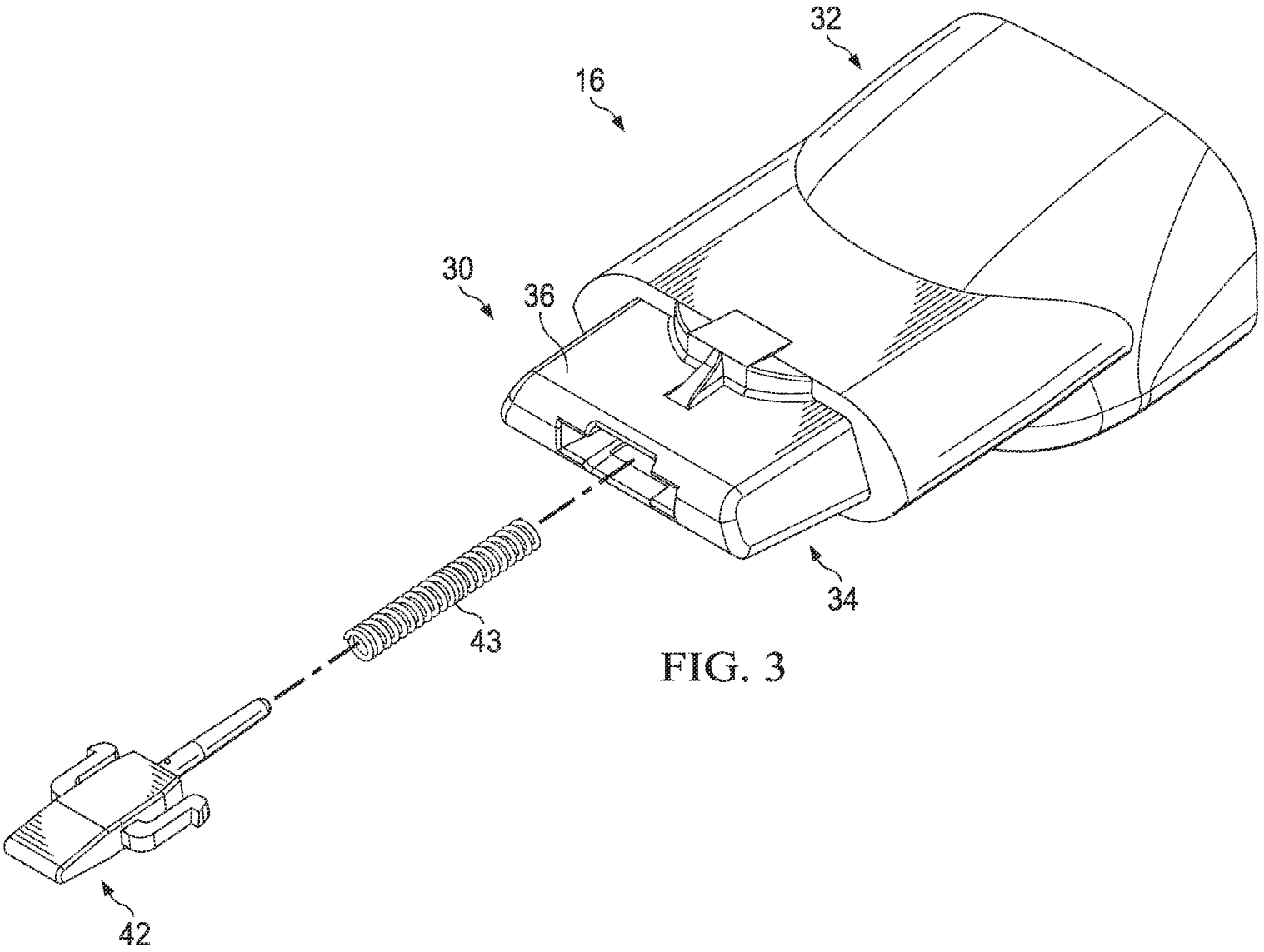
FIG. 3 is an exploded isometric view depicting the adapter of FIG. 1.

Referring now to FIGS. 1 and 3, the cartridge engaging portion 30 can comprise a stem 34 having an upper surface 36 (FIG. 3) and a lower surface 38 (FIG. 1). The lower surface 38 can define a pair of recesses 40 that are configured to interact with the protrusions 22 of the cartridge 14 to facilitate retention of the cartridge 14 thereto. A tongue member 42 can extend through the stem 34 and can be slidable with respect to the stem 34 between an extended position (shown in FIG. 1) and a retracted position (not shown). As illustrated in FIG. 3, the adapter 16 can include a spring 43 that biases the tongue member 42 into the extended position which can facilitate forward pivoting of a blade portion of the cartridge 14.

Figure 4:
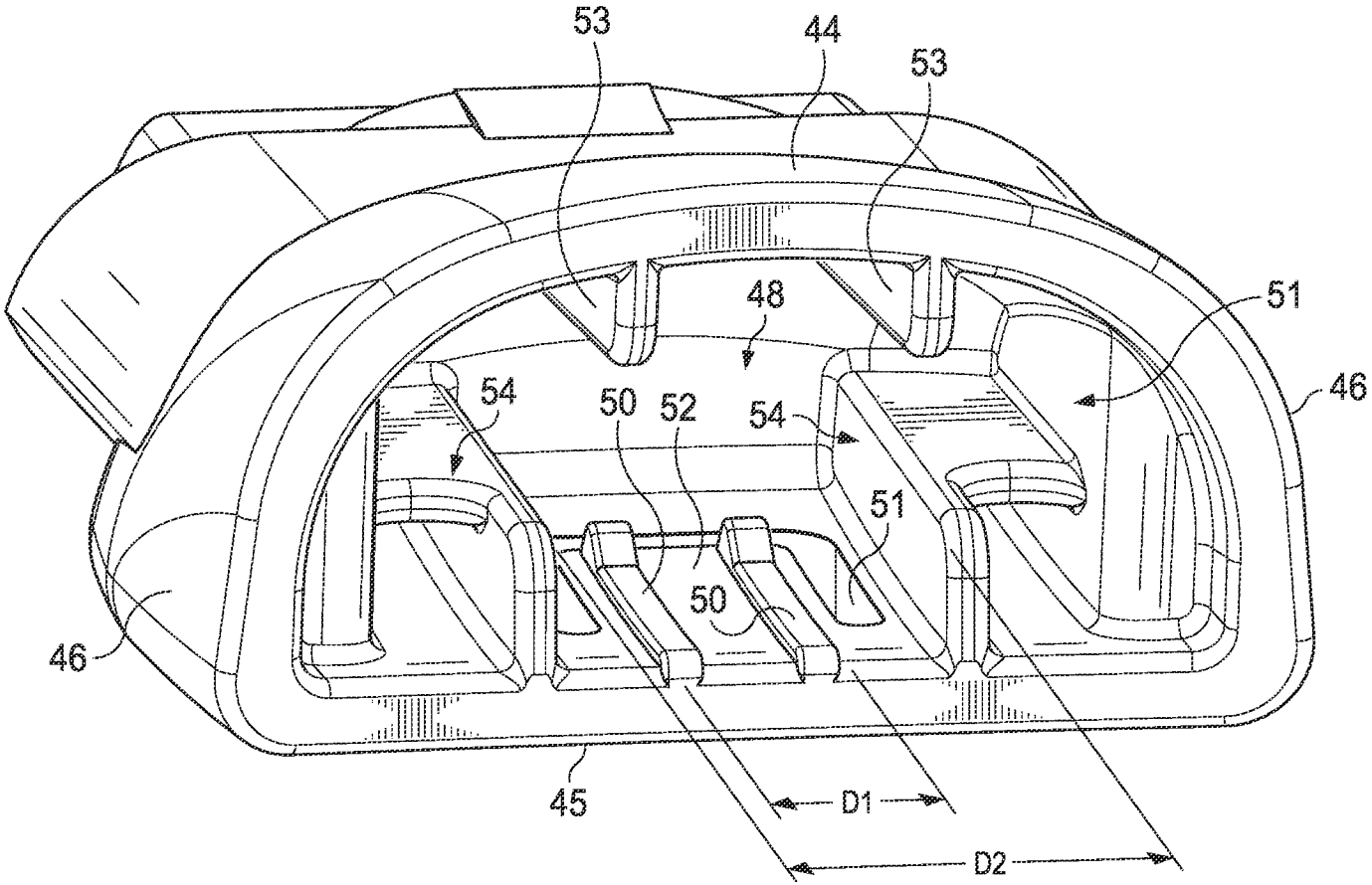
FIG. 4 is a rear isometric view depicting the adapter of FIG. 1.

Referring now to FIG. 4, the handle engaging portion 32 can comprise an upper wall 44, a lower wall 45 and a pair of sidewalls 46 that cooperate to define a receptacle 48. The receptacle 48 can be the same general shape as the stem 27 of the handle 12 to allow the stem 27 to be received into the receptacle 48. A pair of handle protrusions 50 can extend from the lower wall 45 towards the upper wall 44. The pair of handle protrusions 50 can be spaced apart from each other by a distance D1 that is substantially the same width as the central recess 29 of the handle 12. When the stem 27 is inserted in the receptacle 48, each of the handle protrusions 50 can engage the central recess 29 to facilitate selective retention of the adapter 16 to the handle 12.

In one embodiment, the lower wall 45 can define a U-shaped channel 51 that defines a tab portion 52. In such an embodiment, the pair of handle protrusions 50 can be located on the tab portion 52 such that, when the stem 27 of the handle 12 is inserted into the receptacle 48, the tab portion 52 can be urged downwardly, to accommodate insertion of the handle protrusions 50 into the central recess 29. The handle engaging portion 32 can also comprise a pair of shoulders 54 that extend from the lower wall 45 and are positioned on opposite sides of the handle protrusions 50. The shoulders 54 can be spaced from the upper wall 44 and can be spaced apart by a second distance D2 that is greater than the first distance D1. The handle engaging portion 32 can also comprise a pair of upper ribs 53 that extend from the upper wall 44. When the stem 27 of the handle 12 is inserted into the receptacle 48, the stem 27 can ride along the shoulders 54 and the upper ribs 53 can contact the stem 27.

It is to be appreciated that the adapter 16 can be selectively decoupled from the handle 12 via a slidable collar 55 that is interposed between the handle 12 and the adapter 16. The collar 55 can be slid forward and away from the handle 12 which can overcome the frictional engagement between the handle protrusions 50 and the central recess 29 to push the adapter 16 away from the handle 12. It is also to be appreciated that the cartridge 14 can be manually decoupled from the adapter 16 by pulling the cartridge 14 and adapter 16 away from each other with enough force to overcome the frictional interaction between the neck portion 18 and the stem 34.

Figure 5:
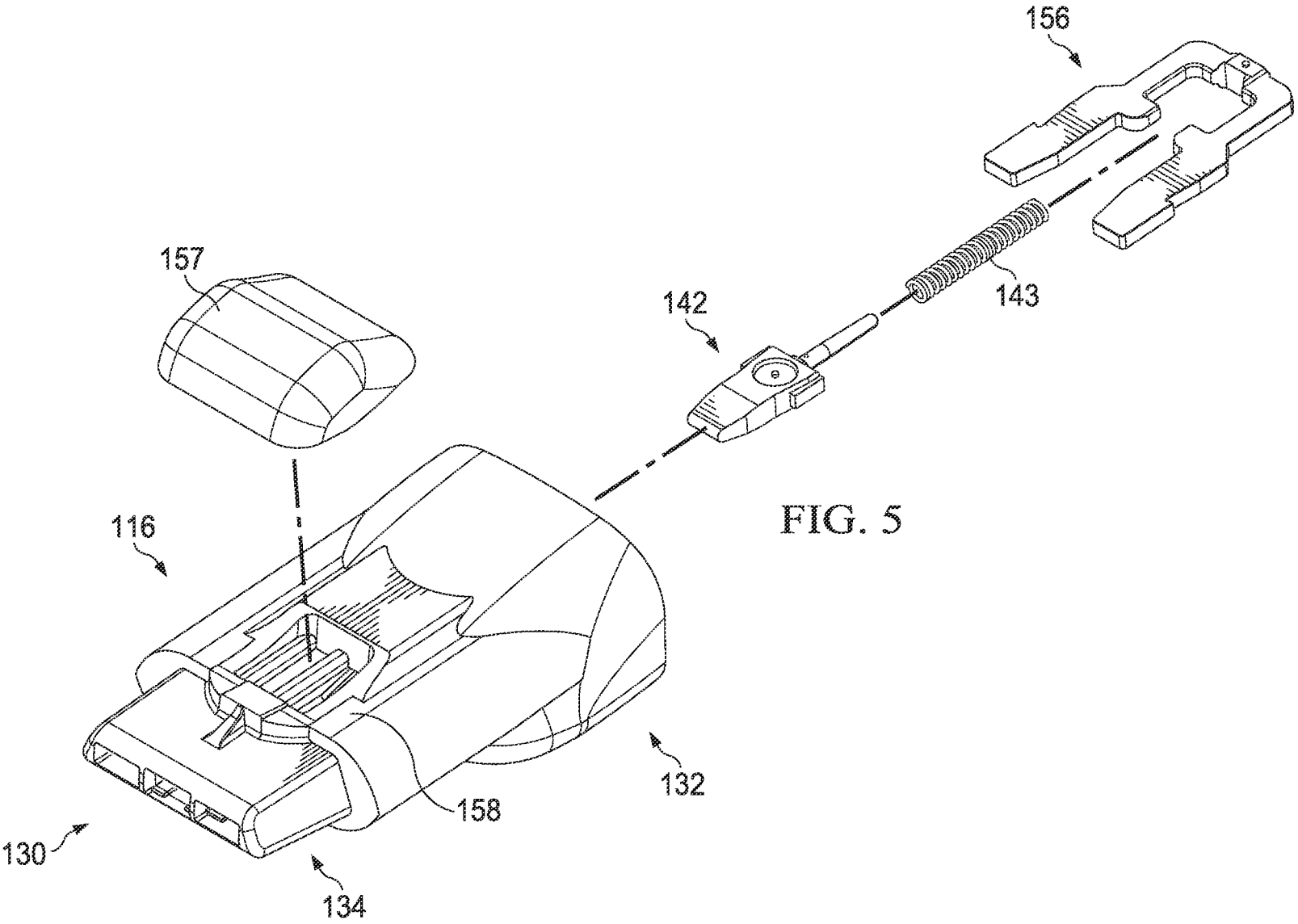
FIG. 5 is an exploded isometric view depicting an adapter in accordance with another embodiment.

FIG. 5 illustrates an adapter 116 according to another embodiment. The adapter 116 can be similar to or the same as in many respects as the adapter 16 of FIGS. 1-4. For example, the adapter 116 can include a cartridge engaging portion 130 and a handle engaging portion 132 that are coupled together. The cartridge engaging portion 130 can be configured similarly to the cartridge engaging portion 30 of FIGS. 1-4 such that the cartridge engaging portion 130 can be releasably mounted to a cartridge (e.g., 14) having a MACH3® docking interface. For example, a tongue member 142 can extend through a stem 134 and can be slidable with respect to the stem 134. A spring 143 can bias the tongue member 142 into an extended position.

However, the adapter 116 can include a push member 156 that is slidably coupled with the cartridge engaging portion 130 and slidable between a retracted position and an extended position. The spring 143 can bias the push member 156 into the retracted position. A button 157 can be slidably coupled with an upper wall 158 and can engage the push member 156. The button 157 and can be slid (e.g., by a user's finger) from a relaxed position to an ejecting position to move the push member 156 to the extended position which can cause it to protrude from the stem 134 thereby facilitating ejection of an attached cartridge. In one embodiment, the push member 156 can be substantially U-shaped.

Figure 6:
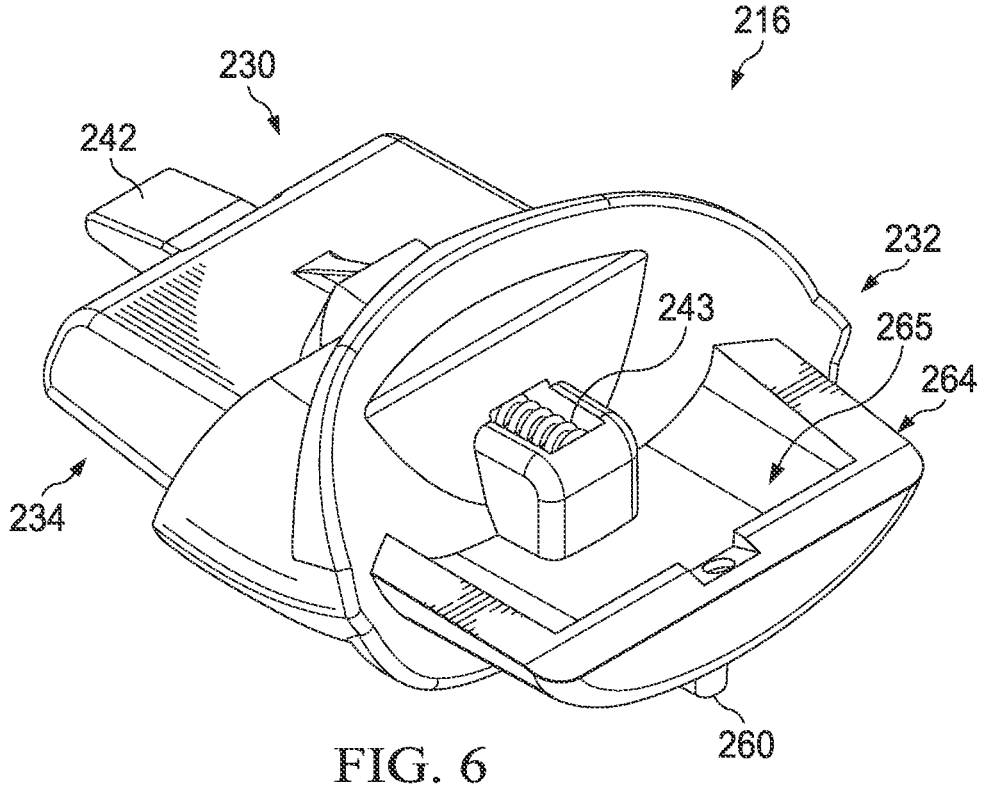
FIG. 6 is an upper isometric view depicting an adapter in accordance with yet another embodiment.
Figure 7:
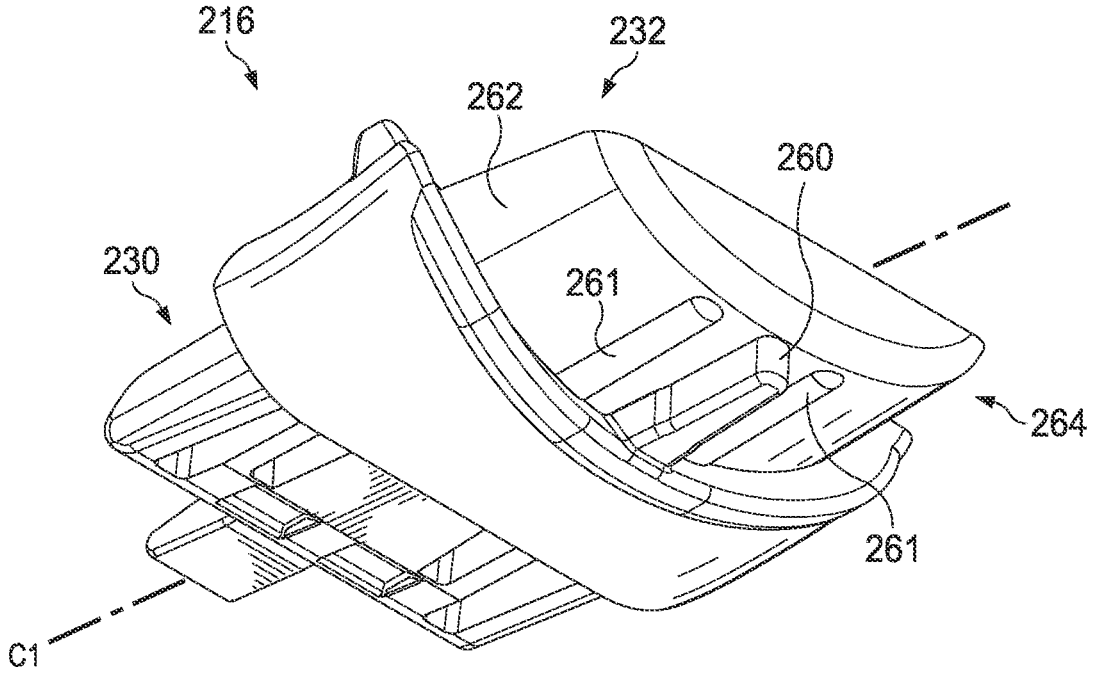
FIG. 7 is a lower isometric view depicting the adapter of FIG. 6.

FIGS. 6-7 illustrate an adapter 216 according to another embodiment. The adapter 216 can be similar to or the same as in many respects as the adapter 16 of FIGS. 1-4. For example, adapter 216 can include a cartridge engaging portion 230 and a handle engaging portion 232 that are coupled together. The cartridge engaging portion 230 can be configured similarly to the cartridge engaging portion 30 of FIGS. 1-4 such that the cartridge engaging portion 230 can be releasably mounted to a cartridge (e.g., 14) having a MACH3® docking interface. For example, a tongue member 242 can extend through a stem 234 and can be slidable with respect to the stem 234. A spring 243 can bias the tongue member 242 into an extended position.

However, the handle engaging portion 232 can be configured to receive a handle that is compatible with the AMERICAN SAFETY RAZOR® (ASR) docking interface. For example, as illustrated in FIG. 7, the handle engaging portion 232 can include a central protrusion 260 and a pair of boundary protrusions 261 disposed on an outer surface 262 of a support member 264 of the handle engaging portion 232. The central protrusion 260 can be spaced from, and disposed between, the boundary protrusions 261 and can have a greater height (e.g., relative to the outer surface 262) than the boundary protrusions 261. In one embodiment, the central protrusion 260 and the boundary protrusions 261 can be elongate protrusions that extend substantially parallel to a centerline Cl of the adapter 216. When the support member 264 is inserted into a receptacle of an ASR handle (not shown) to secure the ASR handle to the adapter 216, the central protrusion 260 can extend through an elongate slot of a lower wall of the ASR handle (not shown). The boundary protrusions 261 can contact the lower wall adjacent to the elongate slot to facilitate frictional engagement between the support member 264 and the handle. A button assembly of the ASR handle can extend into an upper recess 265 (FIG. 6) defined by the support member 264 to facilitate selective retention of the adapter 216 to the ASR handle. One example of such an ASR docking interface is disclosed in U.S. Pat. No. 8,079,147, which is hereby incorporated by reference in its entirety.

It is to be appreciated that the adapter 216 can be selectively decoupled from the ASR handle via a button on the ASR handle that is configured to facilitate ejection of a compatible cartridge. The button can be pushed forwardly to release the adapter 216 from the ASR handle. It is also to be appreciated that, in some embodiments, the adapter 216 and the MACH3® cartridge (not shown) can be sufficiently coupled together such that the adapter 216 is disposable with the MACH3® cartridge. In other embodiments, the adapter 216 can be manually decoupled from the MACH3® cartridge by pulling the MACH3® cartridge and the adapter 216 away from each other with enough force to overcome the frictional interaction between the MACH3® cartridge and the stem 234.

Figure 8:
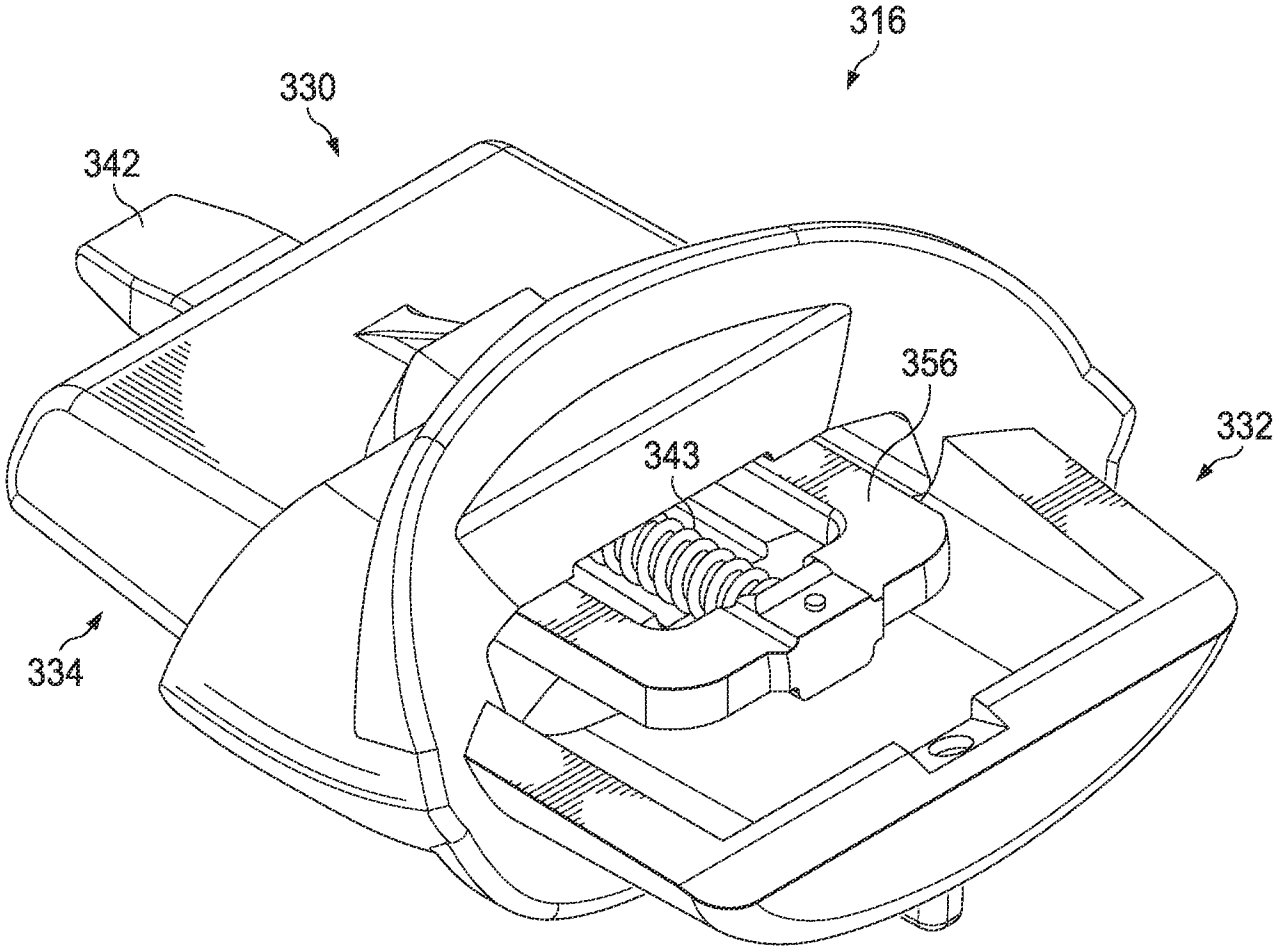
FIG. 8 is an upper isometric view depicting an adapter in accordance with still yet another embodiment.

FIG. 8 illustrates an adapter 316 according to another embodiment. The adapter 316 can be similar to or the same as in many respects as the adapter 216 of FIGS. 6-7. For example, the adapter 316 can include a cartridge engaging portion 330 and a handle engaging portion 332 that are coupled together. The cartridge engaging portion 330 can be configured similarly to the cartridge engaging portion 30 of FIGS. 1-4 such that the cartridge engaging portion 330 can be releasably mounted to a cartridge (e.g., 14) having a MACH3® docking interface. For example, a tongue member 342 can extend through a stem 334 and can be slidable with respect to the stem 334. A spring 343 can bias the tongue member 342 into an extended position.

However, the adapter 316 can include a push member 356 that is slidably coupled with the cartridge engaging portion 330 and slidable between a retracted position and an extended position. The spring 343 can bias the push member 356 into the retracted position. In one embodiment, the push member 356 can be substantially U-shaped.

It is to be appreciated that the adapter 316 can be selectively decoupled from the ASR handle via a button on the ASR handle that is configured to facilitate ejection of a compatible cartridge. The button can be pushed downwardly to release the adapter 316 from the ASR handle. It is also to be appreciated that the MACH3® cartridge (not shown) can be decoupled from the adapter 316 by sliding the button forwardly which can urge the push member 356 to the extended position to flex the arms (e.g., 25) of the MACH3® cartridge downwardly to disengage the protrusions (e.g., 22) to allow the MACH3® cartridge to be removed from the stem 334.

FIGS. 9*a*-11 illustrate an adapter 416 according to another embodiment. The adapter 416 can be similar to or the same as in many respects as the adapter 16 of FIGS. 1-4. For example, adapter 416 can include a cartridge engaging portion 430 and a handle engaging portion 432 that are coupled together. The cartridge engaging portion 430 can be configured similarly to the cartridge engaging portion 30 of FIGS. 1-4 such that the cartridge engaging portion 430 can be releasably mounted to a cartridge (e.g., 14) having a MACH3® docking interface. For example, a tongue member 442 (FIG. 9*a*) can extend through a stem 434 and can be slidable with respect to the stem 434. A spring 443 can bias the tongue member 442 (FIG. 9*a*) into an extended position (shown in FIG. 9*a*).

Figure 9A:
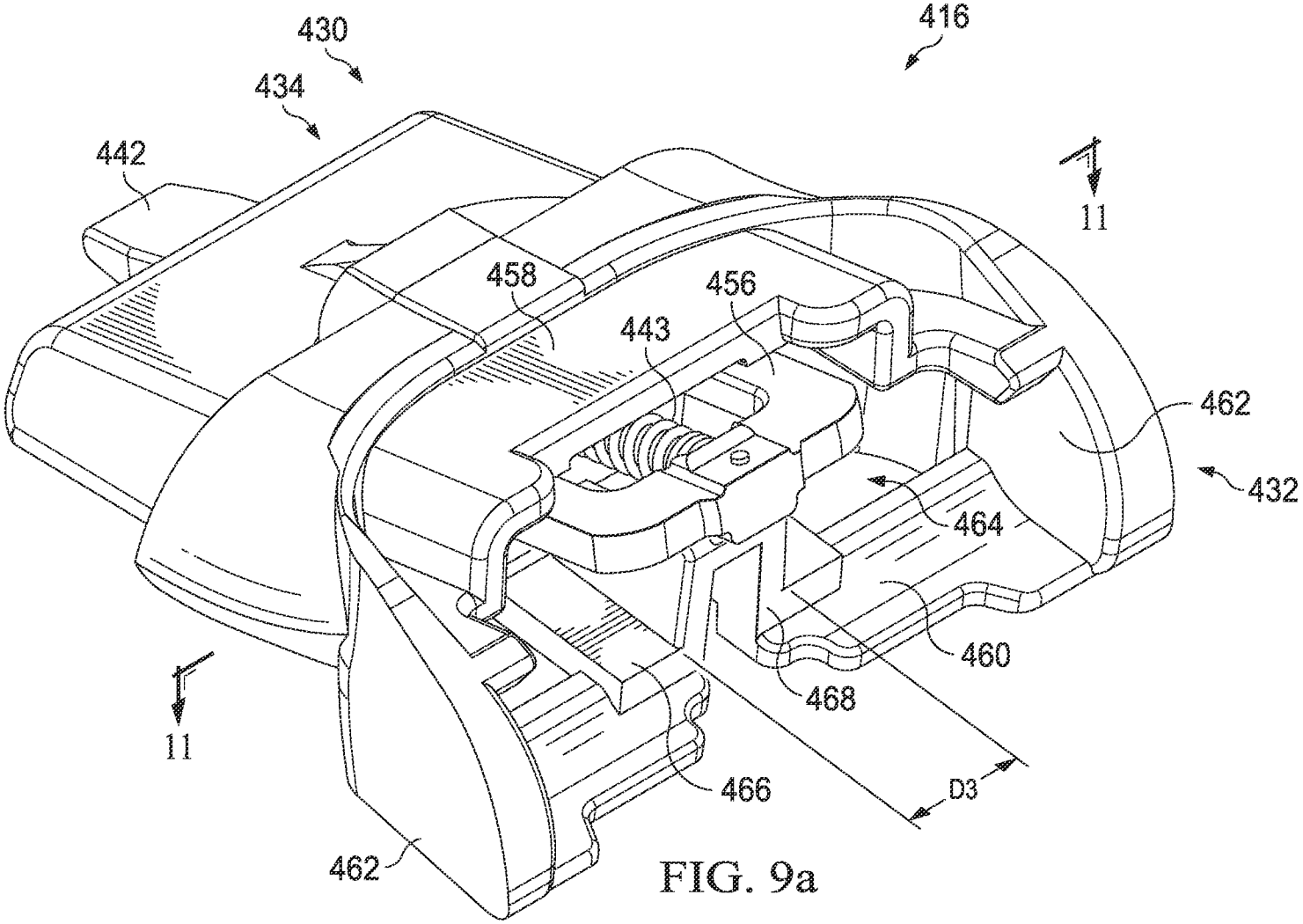
FIG. 9*a* is an upper isometric view depicting an adapter in accordance with still yet another embodiment.
Figure 9B:
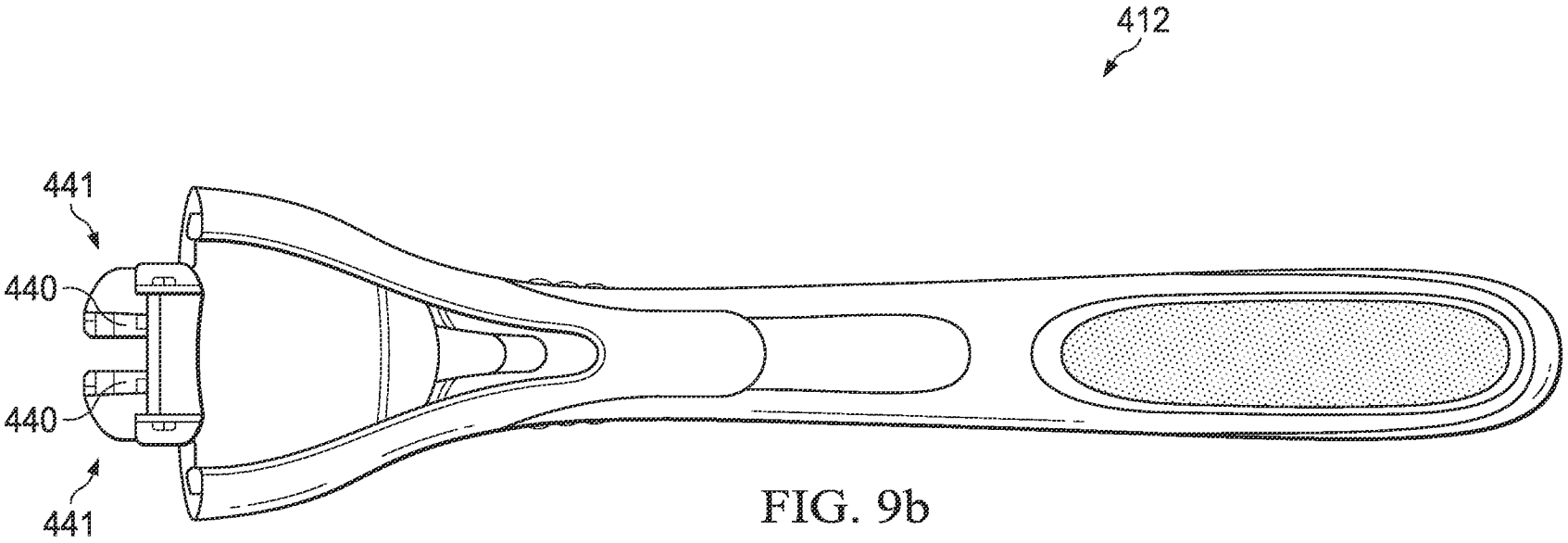
FIG. 9*b* is a bottom view of a razor handle configured to receive the adapter of FIG. 9*a;*
Figure 10:
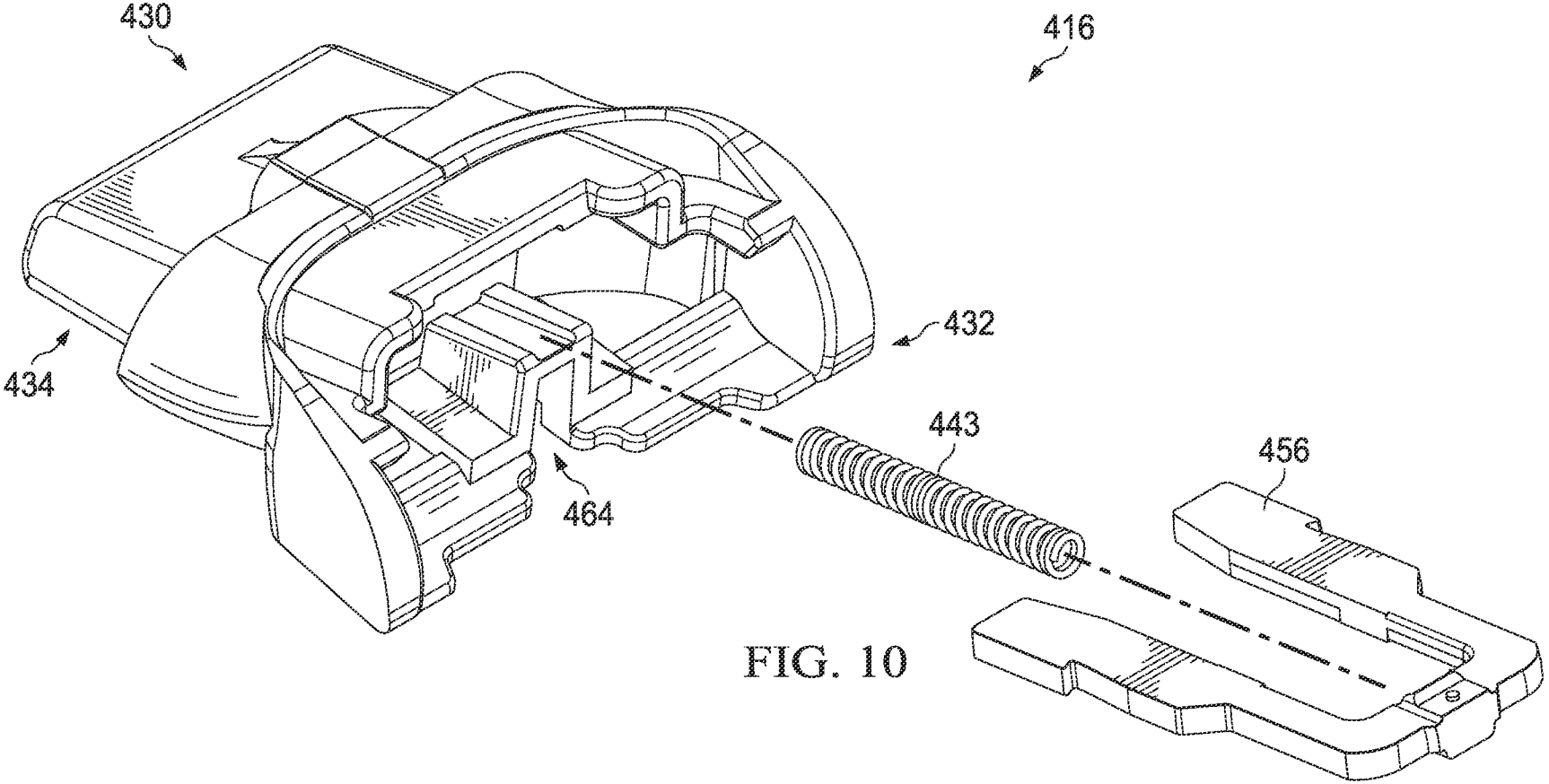
FIG. 10 is an exploded isometric view depicting the adapter of FIG. 9*a*, but with a tongue member removed for clarity of illustration.
Figure 11:
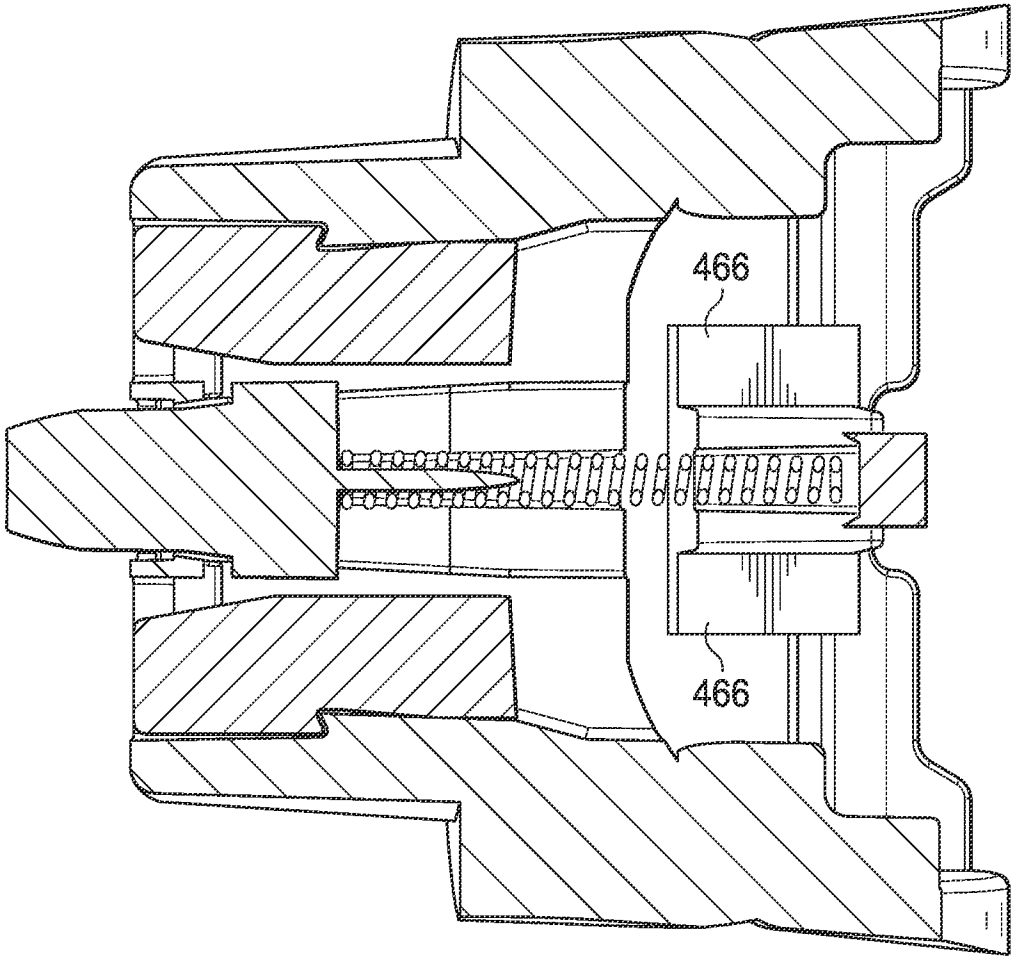
FIG. 11 is a cross sectional view taken along the line 11-11 of FIG. 9*a;*

However, the handle engaging portion 432 can be configured to receive a handle 412, as shown in FIG. 9*b* that is compatible with the DORCO® docking interface. For example, as illustrated in FIG. 9*a*, the handle engaging portion 432 can include an upper wall 458, a lower wall 460, and a pair of sidewalls 462 that cooperate to define a receptacle 464. A pair of engagement portions 466 (FIG. 11) can extend radially inwardly from the lower wall 460 and can be spaced from each other by a distance D3. A blocking portion 468 can extend between, and can extend higher than (relative to the lower wall 460), the engagement portions 466.

When the DORCO® handle 412 (FIG. 9*b*) is inserted in the receptacle 464 of the handle engaging portion 432 to secure the DORCO® handle 412 to the adapter 416, the engagement portions 466 can engage respective recesses 440 defined by a pair of forked stems 441 to facilitate selective retention of the adapter 416 to the DORCO® handle 412. The distance between the forked stems 441 can be substantially the same as the distance D3 such that the blocking portion 468 is interposed between the forked stems 441 when the DORCO® handle 412 is engaged with the adapter 416. Additional details of an example DORCO® handle and docking interface is disclosed in U.S. Pat. No. 8,590,162, which is hereby incorporated by reference in its entirety.

The adapter 416 can include a push member 456 that is slidably coupled with the cartridge engaging portion 430 and slidable between a retracted position and an extended position. The spring 443 can bias the push member 456 into the retracted position. In one embodiment, the push member 456 can be substantially U-shaped.

It is to be appreciated that the cartridge can be selectively decoupled from the adapter 416 by actuating a button (not shown) on the DORCO® handle 412 that is configured to facilitate ejection of a compatible cartridge. The button can be slid forwardly to extend a finger member towards the adapter 416. As the finger member travels forward it can urge the push member 456 forwardly to contact the cartridge thereby facilitating ejection from the adapter 416. It is also to be appreciated that the MACH3® cartridge (not shown) can be manually decoupled from the adapter 416 by sliding the button forwardly which can urge the push member 456 to the extended position to push the MACH3® cartridge away from the stem 434.

Figure 12:
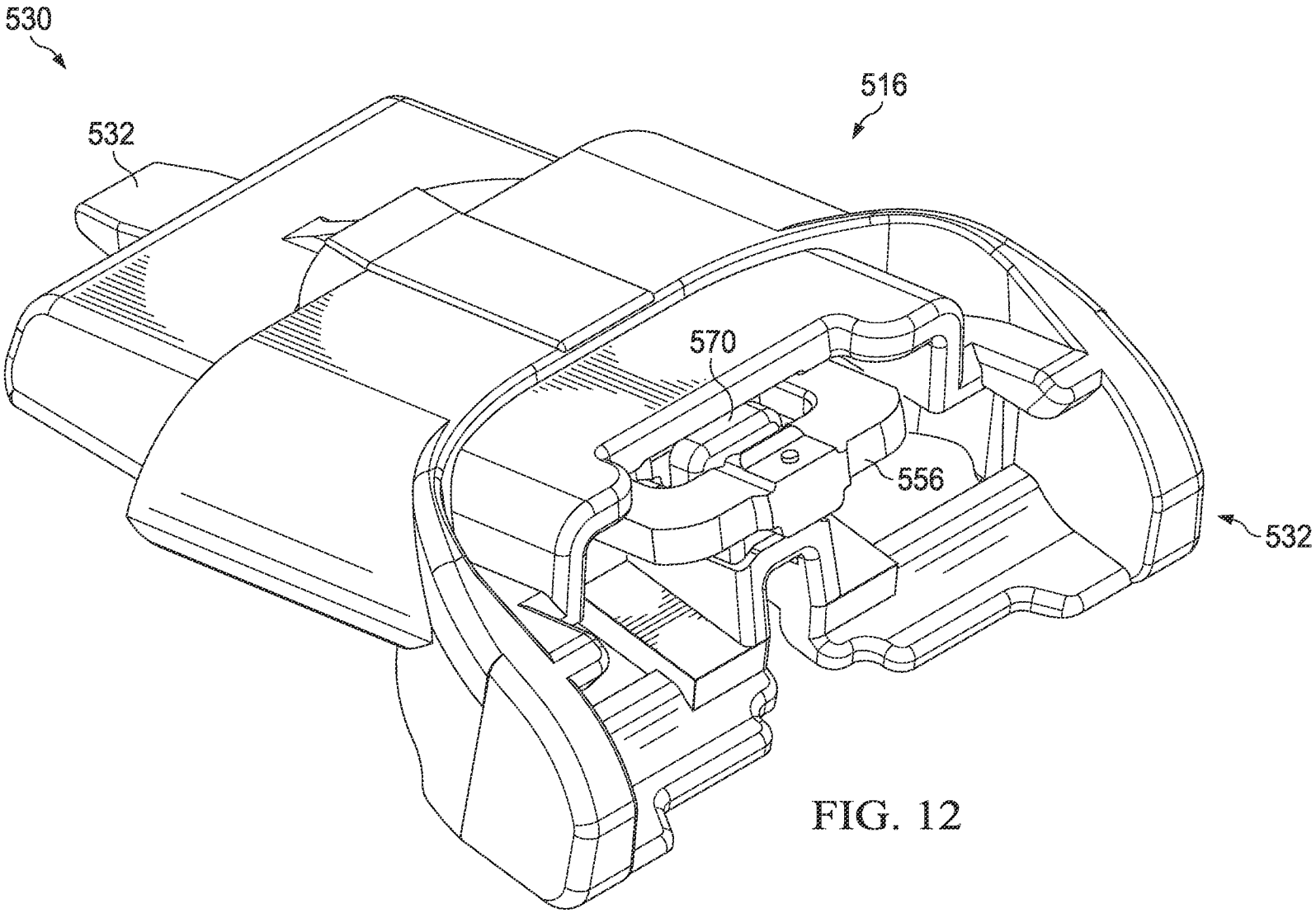
FIG. 12 is a lower isometric view depicting an adapter in accordance with still yet another embodiment, but with a tongue member removed for clarity of illustration.
Figure 13:
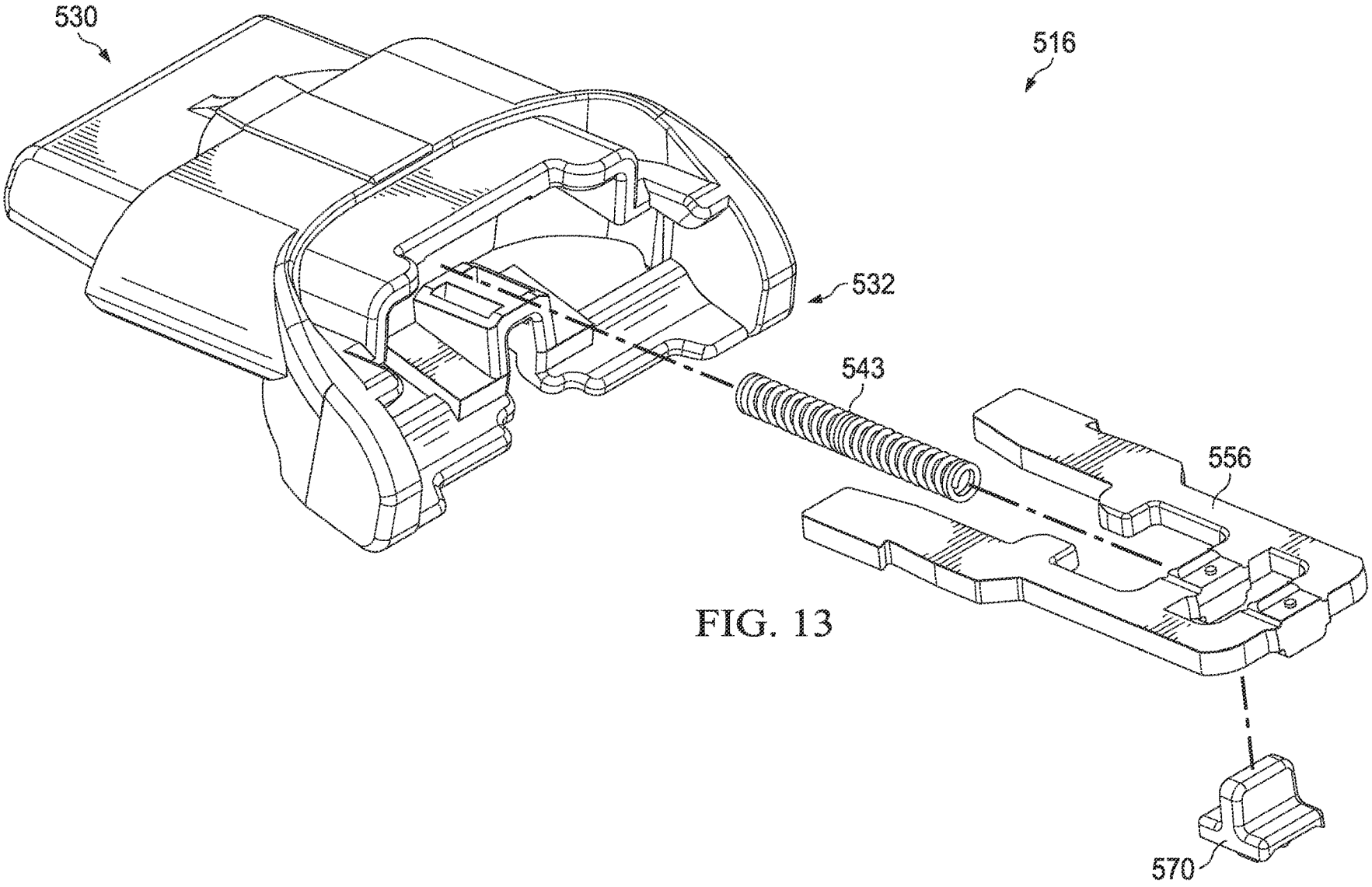
FIG. 13 is an exploded isometric view depicting the adapter of FIG. 12.

FIGS. 12-13 illustrate an adapter 516 according to another embodiment. The adapter 516 can be similar to or the same as in many respects as the adapter 16 of FIGS. 1-4. For example, the adapter 516 can include a cartridge engaging portion 530 and a handle engaging portion 532 that are coupled together. The cartridge engaging portion 530 can be configured similarly to the cartridge engaging portion 30 of FIGS. 1-4 such that the cartridge engaging portion 530 can be releasably mounted to a cartridge (e.g., 14) having a MACH3® docking interface. A spring 543 can bias a tongue member (not shown) into an extended position and can bias a push member 556 into a retracted position. The adapter 516, however, can include a slider tab 570 coupled with the push member 556 and configured to facilitate ejection of the adapter 516 from the DORCO® handle. The slider tab 570 can be substantially T-shaped and can engage a rear portion of the push member 556. When the button on the DORCO® handle is slid forward, the finger member of the DORCO® handle can contact the slider tab 570 first to facilitate sliding of the push member 556 towards the extended position thereby ejecting the cartridge. Once the push member 556 has reached the extended position, further sliding of the button can cause the finger member to eject the adapter 516 from the DORCO® handle.

EXAMPLES

A. An adapter for coupling each of a razor handle and a razor cartridge together, the adapter comprising:
  a handle engaging portion comprising:
    at least one wall that defines a receptacle for receiving a razor handle;
    a first handle protrusion extending from the at least one wall; and
    a second handle protrusion extending from the at least one wall and being spaced from the first handle protrusion;
    wherein the first handle protrusion and the second handle protrusion are configured to engage a first recess and a second recess, respectively, of a razor handle;
  a cartridge engaging portion coupled with the handle engaging portion, the cartridge engaging portion comprising:
    a stem that defines a first recess and a second recess for selectively engaging a first cartridge protrusion and a second cartridge protrusion;
    a tongue member slidably coupled with the stem and configured to contact a cartridge.

B. The adapter according to Paragraph A wherein the at least one wall comprises an upper wall and a lower wall and the first handle protrusion and the second handle protrusion extend from the lower wall.

C. The adapter according to any of Paragraphs A and B wherein the first handle protrusion and the second handle protrusion are spaced apart by a distance that substantially the same as a distance between a first recess and a second recess of a razor handle.

D. The adapter according to any of Paragraphs A-C further comprising a blocking portion that extends between the first handle protrusion and the second handle protrusion.

E. The adapter according to Paragraph D wherein the blocking portion extends higher than the first handle protrusion and the second handle protrusion F. The adapter according to any of Paragraphs A-E further comprising a push member slidably coupled with the cartridge engaging portion and slidable between a retracted position and an extended position wherein sliding the push member from the retracted position to the extended position facilitates ejection of a cartridge from the stem.

G. The adapter according to any of Paragraphs A-F further comprising a biasing member coupled with the tongue member and configured to bias the tongue member into an extended position.

H. The adapter according to Paragraph G wherein the biasing member is further coupled with the push member and is configured to bias the push member into the retracted position.

I. The adapter according to any of Paragraphs F and H wherein the push member is substantially U-shaped.

J. The adapter according to any of Paragraphs F, H, and I further comprising a slider tab coupled with the push member and configured to facilitate ejection of the adapter from a razor handle.

K. An adapter for coupling each of a razor handle and a razor cartridge together, the adapter comprising:
  a handle engaging portion comprising:
    a support member that defines a recess and comprises an outer surface that is external to the recess; and
    at least one protrusion disposed on the outer surface and configured to frictionally engage a razor handle;
  a cartridge engaging portion coupled with the handle engaging portion, the cartridge engaging portion comprising:
    a stem that defines a first recess and a second recess for selectively engaging a first cartridge protrusion and a second cartridge protrusion;
    a tongue member slidably coupled with the stem and configured to exert external force on a cartridge.

L. The adapter according to Paragraph K wherein the at least one protrusion comprises a first protrusion and a pair of second protrusions that are spaced apart and are positioned with the first protrusion disposed therebetween.

M. The adapter according to Paragraph L wherein the first protrusion has a greater height than each of the second protrusions.

N. The adapter according to any of Paragraphs L and M wherein the first protrusion and the pair of second protrusions are elongate protrusions that extend substantially parallel to a centerline of the adapter.

O. The adapter according to any of Paragraphs K-N further comprising a push member slidably coupled with the cartridge engaging portion and slidable between a retracted position and an extended position wherein sliding the push member from the retracted position to the extended position facilitates ejection of a cartridge from the stem.

P. The adapter according to any of Paragraphs K-O further comprising a biasing member coupled with the tongue member and configured to bias the tongue member into an extended position.

Q. The adapter according to Paragraph P wherein the biasing member is further coupled with the push member and is configured to bias the push member into the installed position.

R. The adapter according to Paragraph L wherein the push member is substantially U-shaped.

S. An adapter for coupling each of a razor handle and a razor cartridge together, the adapter comprising:
a handle engaging portion comprising:
at least one wall that defines a receptacle for receiving a razor handle; and
at least one handle protrusion extending from the at least one wall and configured to engage a central recess of a razor handle;
a cartridge engaging portion coupled with the handle engaging portion, the cartridge engaging portion comprising:
a stem that defines a first recess and a second recess for selectively engaging a first cartridge protrusion and a second cartridge protrusion;
a tongue member slidably coupled with the stem and configured to contact a cartridge.

T. The adapter according to Paragraph S wherein the at least one wall comprises an upper wall and a lower wall and the at least one handle protrusion extends from the lower wall.

U. The adapter according to any of Paragraphs S and T wherein the at least one handle protrusion comprises a first handle protrusion and a second handle protrusion that are spaced apart by a first distance.

V. The adapter according to Paragraph T further comprising a pair of shoulders extending from the lower wall and being positioned on opposite sides of the first handle protrusion and the second handle protrusion, wherein:
the pair of shoulders are spaced apart by a second distance; and
the first distance is less than the second distance.

W. The adapter according to Paragraph S wherein the pair of shoulders are spaced from the upper wall.

X. The adapter according to any of Paragraphs T and V wherein the lower wall defines a tab portion and the first handle protrusion and the second handle protrusion are located on the tab portion.

Y. The adapter according to any of Paragraphs T, V, and X wherein the lower wall defines a U-shaped channel that defines the tab portion.

Z. The adapter according to any of Paragraphs S-Y further comprising a pair of shoulders extending from the at least one wall and positioned on opposite sides of the at least one handle protrusion.

AA. The adapter according to Paragraph Z wherein the pair of shoulders are spaced from the upper wall.

BB. The adapter according to any of Paragraphs S-AA further comprising a push member slidably coupled with the cartridge engaging portion and slidable between a retracted position and an extended position wherein sliding the push member from the retracted position to the extended position facilitates ejection of a cartridge from the stem.

CC. The adapter according to any of Paragraphs S-BB further comprising a biasing member coupled with the tongue member and configured to bias the tongue member into an extended position.

DD. The adapter according to Paragraph CC wherein the biasing member is further coupled with the push member and is configured to bias the push member into the retracted position.

EE. The adapter according to any of Paragraphs BB and DD wherein the push member is substantially U-shaped.

FF. The adapter according to any of Paragraphs S-EE further comprising a button slidably coupled with the at least one wall and slidable between a relaxed position and an ejecting position wherein moving the button from the relaxed position to the ejecting position facilitates sliding of the push member from the retracted position to the extended position.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An adapter for coupling between a razor handle and a razor cartridge together, the adapter being a separate component from said razor handle and said razor cartridge, the adapter comprising:
a handle engaging portion comprising:
at least one wall that defines a receptacle for receiving the razor handle;
a first handle protrusion extending from the at least one wall; and
a second handle protrusion extending from the at least one wall and being spaced from the first handle protrusion;
wherein the first handle protrusion and the second handle protrusion are inside the handle engaging portion and configured to engage a first recess and a second recess, respectively, of the razor handle;

a cartridge engaging portion coupled with the handle engaging portion, the cartridge engaging portion comprising:

a stem that defines a first recess and a second recess for selectively engaging a first cartridge protrusion and a second cartridge protrusion of the razor cartridge;

a tongue member slidably coupled with the stem and configured to contact the razor cartridge.

2. The adapter of claim 1 wherein the at least one wall comprises an upper wall and a lower wall and the first handle protrusion and the second handle protrusion extend from the lower wall.

3. The adapter of claim 2 wherein the first handle protrusion and the second handle protrusion are spaced apart by a distance that substantially the same as a distance between the first recess and the second recess of the razor handle.

4. The adapter of claim 2 further comprising a blocking portion that extends between a pair of engagement portions extending from the lower wall.

5. The adapter of claim 4 wherein the blocking portion extends higher than the pair of engagement portions relative to the lower wall.

6. The adapter of claim 1 further comprising a push member slidably coupled with the cartridge engaging portion and slidable between a retracted position and an extended position wherein sliding the push member from the retracted position to the extended position facilitates ejection of a cartridge from the stem.

7. The adapter of claim 6 further comprising a biasing member coupled with the tongue member and configured to bias the tongue member into an extended position.

8. The adapter of claim 7 wherein the biasing member is further coupled with the push member and is configured to bias the push member into the retracted position.

9. The adapter of claim 6 wherein the push member is substantially U-shaped.

* * * * *